US005090944A

United States Patent [19]

Kyo et al.

[11] Patent Number: 5,090,944

[45] Date of Patent: Feb. 25, 1992

[54] MAGNETIC-DRIVE DEVICE FOR ROTARY MACHINERY

[75] Inventors: Osamu Kyo; Yasuo Akitsu, both of Handa, Japan

[73] Assignee: NKG Insulators, Ltd., Japan

[21] Appl. No.: 129,406

[22] Filed: Nov. 25, 1987

Related U.S. Application Data

[63] Continuation of Ser. No. 798,413, Nov. 15, 1985, abandoned.

[30] Foreign Application Priority Data

Oct. 16, 1985 [JP] Japan ..... 60-230271

[51] Int. Cl.[5] ..... F01D 25/24

[52] U.S. Cl. ..... 464/29; 417/420

[58] Field of Search ..... 192/84 PM; 310/104; 417/410, 420; 464/29; 501/103, 104

[56] References Cited

U.S. PATENT DOCUMENTS

| | | | |
|---|---|---|---|
| 3,411,450 | 11/1968 | Clifton | 417/420 |
| 3,877,844 | 4/1975 | Klaus et al. | 417/420 |
| 4,065,234 | 12/1977 | Yoshiyuki et al. | 464/29 X |
| 4,115,040 | 9/1978 | Knorr | 464/29 X |
| 4,120,618 | 10/1978 | Klaus | 464/29 X |
| 4,184,090 | 1/1980 | Taiani et al. | 310/104 |
| 4,197,474 | 4/1980 | Honigsbaum | 310/104 |
| 4,207,485 | 6/1980 | Silver | 417/420 X |
| 4,277,707 | 7/1981 | Silver et al. | 417/420 X |
| 4,336,339 | 6/1982 | Okumiya et al. | 501/104 X |
| 4,525,464 | 6/1985 | Claussen et al. | 501/104 X |
| 4,585,499 | 4/1986 | Mase et al. | 501/103 X |
| 4,722,661 | 2/1988 | Mizuno | 417/420 X |

FOREIGN PATENT DOCUMENTS

| | | |
|---|---|---|
| 3337086 | 5/1985 | Fed. Rep. of Germany . |
| 59-180099 | 10/1984 | Japan . |
| 1242243 | 8/1971 | United Kingdom . |
| 1496035 | 12/1977 | United Kingdom . |

*Primary Examiner*—Daniel P. Stodola

*Attorney, Agent, or Firm*—Parkhurst, Wendel & Rossi

[57] ABSTRACT

A magnetic-drive device used for rotary machines, having a high torque transmitting efficiency, causing little temperature elevation of treated fluids and exhibiting mechanical strength and thermal shock resistance. The device comprises a chamber formed by combining a front casing with a rear casing to accommodate a rotor supporting a driven magnet. The rear casing consists of a cylindrical partition walled up at its one end with a bottom portion and provided with a flange portion on the other end, which partition having a thickness of 1.5–8 mm and consisting of a ceramic material having a specific resistance of at least $10^7$ Ω-cm. A driving magnet arranged outside the partition is magnetically coupled with the driven magnet through the partition.

3 Claims, 3 Drawing Sheets

MAGNETIC-DRIVE DEVICE FOR ROTARY MACHINERY

This is a continuation of application Ser. No. 798,413 filed Nov. 15, 1985, now abandoned.

BACKGROUND OF THE INVENTION

1. Field of the Invention

The present invention relates to a magnetic-drive device for rotary machinery for transferring or agitating fluids with an impeller driven by rotary motion transmitted from a driving motor through a magnetic coupling means, and more particularly relates to a magnetic-drive device for rotary machinery, having a magnetic coupling means comprising a partition having a novel structure.

2. Related Art Statement

Heretofore, various rotary machines have been employed for transferring, agitating or mixing of chemical fluid materials in the chemical industry. Among those machines, a magnetic-drive centrifugal pump coupled magnetically with and torqued by a driving motor through an interposed cylindrical partition, usually has no shaft sealing means, wherefore any leakage of the liquid being delivered would not occur, so that such pumps have been widely used for transporting liquids such as chemical medicines, petroleum, beverages and the like.

In such a machine, the magnetic coupling can be accomplished by an external driving means comprising a driving magnet arranged concentrically around a driven annular magnet provided on an impeller, an internal driving means comprising a driving magnet arranged inside a driven magnet, or a disc coupling means comprising a driving magnet facing a driven magnet, both magnets being arranged in respective planes perpendicular to the axis of rotation.

Further, those parts which come into contact with liquids, i.e. an impeller, rotor and casing, are made of high quality metal, plastics, ceramics or a plastic-coated or -lined metal that is chemical corrosion-resistant.

Such a magnetic-drive device as used for a centrifugal pump is generally required to fit specifications with repsect to, for instance, corrosion-resistance, pressure-resistance, heat-resistance, etc. of rotary machines to be connected with the device, and further desired to be formed in a compact size as well as to have an increased torque to be transmitted.

If, in order to increase the output of rotary machines such as a pump pressure, the partition is designed with a thickness augmented so as to endure such as increased pump pressure, then not only can compaction be attained but the following problems also will be encountered.

Namely, more eddy current is induced in the magnetic coupling means corresponding to the increment of thickness of the partition and consequently a heat generation loss will result. The heat generation loss lowers the torque transmitting efficienty of the magnet, while it will badly affect fluids being treated and moreover bring about thermal deformation or stress as well as deterioration of corrosion-resistance the of the partition itself. A temperature increment of treated fluids corresponding to the heat generation loss may at times exceed 5 degrees C., so that conventional pumps have been unemployable for such fluids as to undergo chemical changes or the like at an elevated temperature.

If, in order to obviate the influence of the heat generation, the partition is provided with a cooling means comprising, for instance, an increased amount of fluid flow between the rotor and the partition, or a coolant flow through the inside of the partition, itself the distance between the driving magnet and the driven impeller magnet must be increased thereby consequently decreasing the transmitted torque.

As is described above, there have not been any conventional magnetic-drive devices for rotary machinery which could be formed in a compact size, concurrently fitting specifications of requirements for rotary machines.

SUMMARY OF THE INVENTION

Accordingly, it is an object of the present invention to solve the above-described problems, proving a magnetic-drive device for rotary machinery with improved chemical corrosion-resistance together with magnetic coupling means having excellent torque transmitting efficiency.

Another object of the invention is to provide a magnetic-drive device for rotary machinery having a sufficiently reduced heat generation loss such that the temperature of treated fluids will not be appreciably raised.

Still another object of this invention is to provide a magnetic-drive device for rotary machinery of a compact size.

A further object of the invention is to provide a magnetic coupling means comprising a cylindrical partition having a specific structure.

In a magnetic-drive device for rotary machines which comprises a driving motor and a rotatably rotor driven by a magnetic coupling means comprising a driving magnet fixed on a magnet holder connected with the said driving motor and a driven impeller magnet fixed on the rotor, said driving magnet and the driving impeller magnet being combined with each other, there is included a chamber accommodating the rotor and having a cylindrical partition defining the periphery of the chamber, the said partiion having a thickness of 1.5–8 mm and consisting of a ceramic material having a specific resistance of at least $10^3\Omega$-cm, through which partition the driving magnet and the driven impeller magnet are magnetically coupled.

A preferable material to be used for the magnetic-drive device according to the present invention comprises, as a main ingredient, zirconia and in particular zirconia partially stabilized with 2.0–4.0 mole percent, more preferably 2.3–3.5 mole percent, of $Y_2O_3$. Further, it is preferred that such main ingredient contains 1–5% based on the weight of the main ingredient of alumina ($Al_2O_3$), silica ($SiO_2$) and an alkaline metal oxide.

The magnetic-drive device of the present invention comprises a cylindrical partition having its specific resistance and thickness appropriately defined, so that it has an excellent torque transmitting efficiency, minimizes temperature elevation of treated fluids and is fabricated in a compact size.

DESCRIPTION OF THE PREFERRED EMBODIMENT

Figure 1:
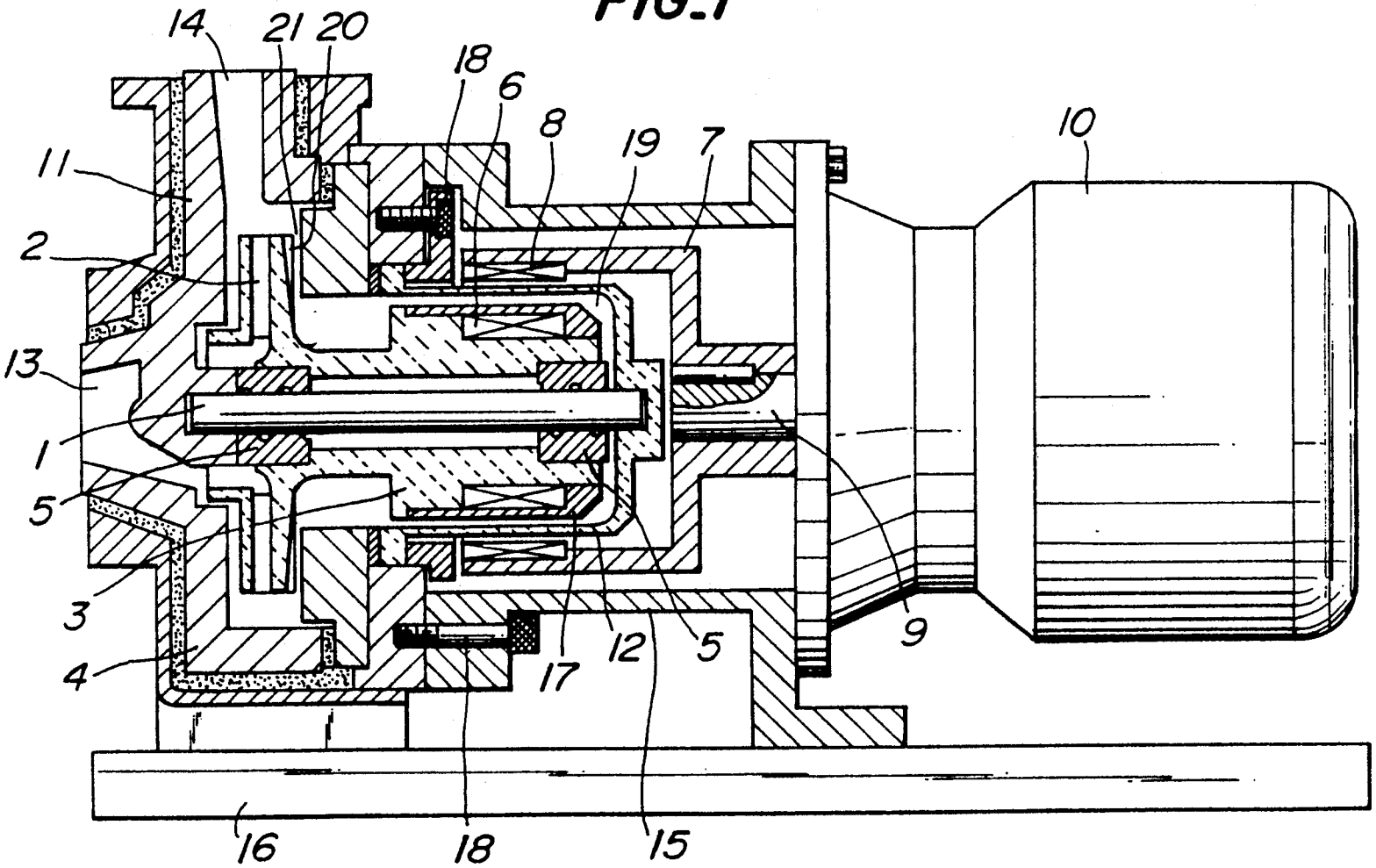
FIG. 1 is a sectional view of a magnetic-drive centrifugal pump which is an embodiment of the present invention.

Embodiments of the present invention will be illustrated in detail below with reference to the accompanying drawings. In FIG. 1, a pump mainly comprises main shaft 1, impeller 2 rotatably mounted on the main shaft 1 by means of bearings 5, rotor 3 formed integrally with the impeller, pump casing 4 enclosing these parts, driven impeller magnet 6 fixed on rotor 3, driving magnet 8 concentrically facing the driven impeller magnet and supported by magnet holder 7, driving shaft 9 to drive magnet holder 7 and driving motor 10.

It is preferred to form impeller 2 integrally with rotor 3, with a ceramic material. As the ceramic material, alumina, zirconia, mullite, silicon carbide, silicon nitride and the like, excellent in chemical corrosion-resistance and mechanical strength, may be usually employed.

Pump casing 4 is mainly composed by combining front casing 11 with rear casing 12. Front casing 11 is provided with inlet 13 and outlet 14 and receives impeller 2. Rear casing 12 accommodates rotor 3.

Front casing 11 will not necessarily require such a high strength as compared with rotor 3 and rear casing 12 (that is the most important part in this invention as will be described hereinafter), so that corrosion-resistance materials, for instance, plastics-lined metals and ceramics such as acid-resistant alumina ceramics or the like may be used for its fabrication.

Outside rear casing 12, driving magnet 8 is arranged concentrically to driven impeller-magnet 6. Driving magnet 8 is attached to magnet holder 7.

The above-mentioned driven impeller magnet 6 and driving magnet 8 are made of a metal of metal oxide having a large coercive force and a large residual flux density.

Magnet holder 7 housed in magnet housing 15 is fixed on and driven by driving shaft 9 of driving motor 10.

The aforementioned pump casing 4, magnet housing 15 and driving motor 10 are placed on bed 16.

The denotations 17, 18, 19, 20 and 21 in the drawing indicate magnet cover, a bolt, a cooling water drainageway, a back-vane provided on the back of the impeller and a back-vane clearance respectively.

Next, rear casing 12 that is the gist of the present invention will be explained referring to FIG. 2.

Figure 2:
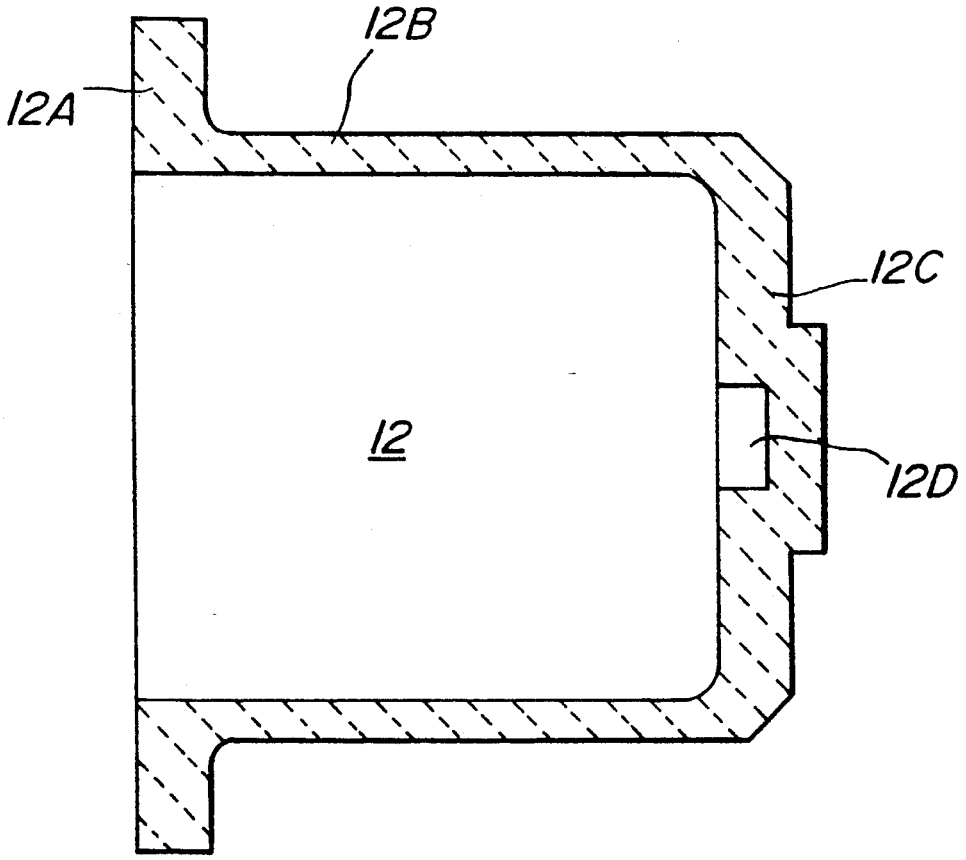
FIG. 2 is an enlarged sectional view of the rear casing shown in FIG. 1, for receiving a rotor.

In FIG. 2, rear casing 12 consists of flange portion 12A, cylindrical sidewall or partition 12B and bottom portion 12C.

Flange portion 12A formed on one end of the sidewall serves to combine rear casing 12 with the front casing forming a chamber to accommodate the impeller or rotor.

The other end of the sidewall is walled up with bottom portion 12C, and in the center of bottom portion 12C, recessed portion 12D is formed to support the main shaft. Sidewall 12B serves as a partition to separate driven impeller magnet 6 and driving magnet 8 magnetically coupled therewith.

Though it will be preferred that the whole rear casing 12 be composed integrally of a ceramic material from the standpoint of mechanical strength and chemical corrosion-resistance, it is recommended to that at least the sidewall be made of a ceramic material.

A preferably thickness ($t_1$) of sidewall or partition 12B is in the range of 1.5–8 mm for the following reason.

When the thickness of sidewall 12B is less than 1.5 mm, the partition will be unable to endure a pressure formed by a driving torque of the magnetic coupling means. Further, in the case where main shaft 1 journaling rotor 3 is supported by bottom portion 12C of rear casing 12, a radial load brought about by the weight and rotation of rotor 3 will facilitate flexure of breakage of sidewall 12B. Furthermore, in the course of manufacture, the thin sidewall may be readily broken by a grinding pressure, may be unable to maintain a finishing accuracy due to deformation, or may be apt to break due to a mechanical impact in assembling processes. During operation, it may be broken by a fluid impact or an oscillation by vibration unpreferably causing its contact with the rotor or driving magnet 8.

On the other hand, it is not preferable for the thickness to exceed 8 mm, because a heat generation loss caused by the magnetic coupling means will increase and a transmitted torque of the magnetic coupling means will decrease.

Namely, the magnet size is required to be enlarged correspondingly with the increment of thickness in order to maintain a level of torque to be transmitted, so that the surface area of the partition interposed between the magnets is corespondingly increased whereby augmenting eddy current generates on the surface of the partition, while the electric resistance of the partition through which the eddy current flows decreases to promote the generation of more eddy current, and thus the heat generation loss will further increase. The heat generation loss is particularly not preferred not only for its deteriorating of the efficiency of the magnetic coupling means but also for the generated heat which raises the temperature of fluids being treated.

Besides, if the partition is made too thick, the distance between the driving magnet and the driven one is naturally increased by the increment of the thickness, so that the torque transmitted by the magnetic coupling means reduces such that specifications of rotary machines cannot be fitted. Moreover, not only can the compaction of the device be achieved by the increment of the thickness, but also certain measures become necessary to absorb the weight increase. Particularly when zirconia ceramic is employed for the partition, a difficulty will be encountered due to a high specific gravity of zirconia ceramic as compared with other ceramics. Furthermore, a defect such as decreased thermal shock resistance will be developed as well.

Ceramic materials for sidewall 12B must have a specific resistance of at least $10^3\Omega$-cm. Its reason is that when smaller than $10^3\Omega$-cm, since sidewall 12B is a partition of the magnetic coupling means, heat generation caused by eddy current will become too big and the torque transmitting efficiency will be lowered.

As the ceramic materials, a partially stabilized zirconia is preferred from the standpoint of mechanical strength and specific resistance. As the zirconia ceramics, those partially stabilized with 2.0–4.0 mole percent of $Y_2O_3$ are preferable, and further those with 2.3–3.5 mole percent of $Y_2O_3$ are more perferable. The reason is that 2–4 mole percent $Y_2O_3$ maximizes the specific resistance, 2–3.5 mole percent does the flexural strength and 2–3 mole percent does the fracture toughness and thermal shock resistance temperature respectively, while 2.3–4.0 mole percent $Y_2O_3$ minimizes deterioration by ageing of the flexural strength.

Furthermore, the zirconia ceramics comprising, as a main ingredient, zirconia or partially stabilized zirconia is preferred to contain, as sintering aids, 1–5% based on the weight of the main ingredient of alumina ($Al_2O_3$), silica ($SiO_2$) and an alkaline metal oxide. The reason for that is that in the course of manufacture of the zirconia ceramics, the sintering aids not only can improve mold strength and moldability as well as lower a sintering temperature, by also can increase specific resistance. If the content is less than 1%, the specific resistance will not increase sufficiently, while if it exceeds 5%, the flexural strength will decrease appreciably.

Such sintering aids are generally to deteriorate a high temperature thermal shock resistance due to an extraordinary thermal expansion accompanied with a crystal transformation at high temperatures of the stabilized zirconia ceramics, and however in the case of the present invention, there are no such problems because temperature of fluids treated in the chemical industry is usually not higher than 200° C.

The thickness of flange portion 12A ($t_3$) and that of bottom portion 12C ($t_2$) or rear casing 12 are preferably made larger than that of sidewall 12B ($t_1$). It is particularly preferred to form the thickness of flange portion 12A ($t_3$) and that of bottom portion 12C ($t_2$) respectively at lest 3 times that of sidewall 12B ($t_1$). The whys and wherefores of it are: in order to make sidewall 12B as thin as possible, fitting specifications of rotary machines to be connected with the magnetic-drive device, it is necessary to minimize to the utmost a stress at the boundary of the sidewall formed by flexural of bottom portion 12C and/or flange portion 12A, so that it is preferred for the thickness of flange portion 12A ($t_3$) and that of bottom portion 12C ($t_2$) to be respectively 3 times that of sidewall 12B ($t_1$).

Though the above explanations was made with respect to a magnetic-drive centrifugal pump as an embodiment of the invention, the invention can also apply to rotary machines other than the centrifugal pump.

Figure 3:
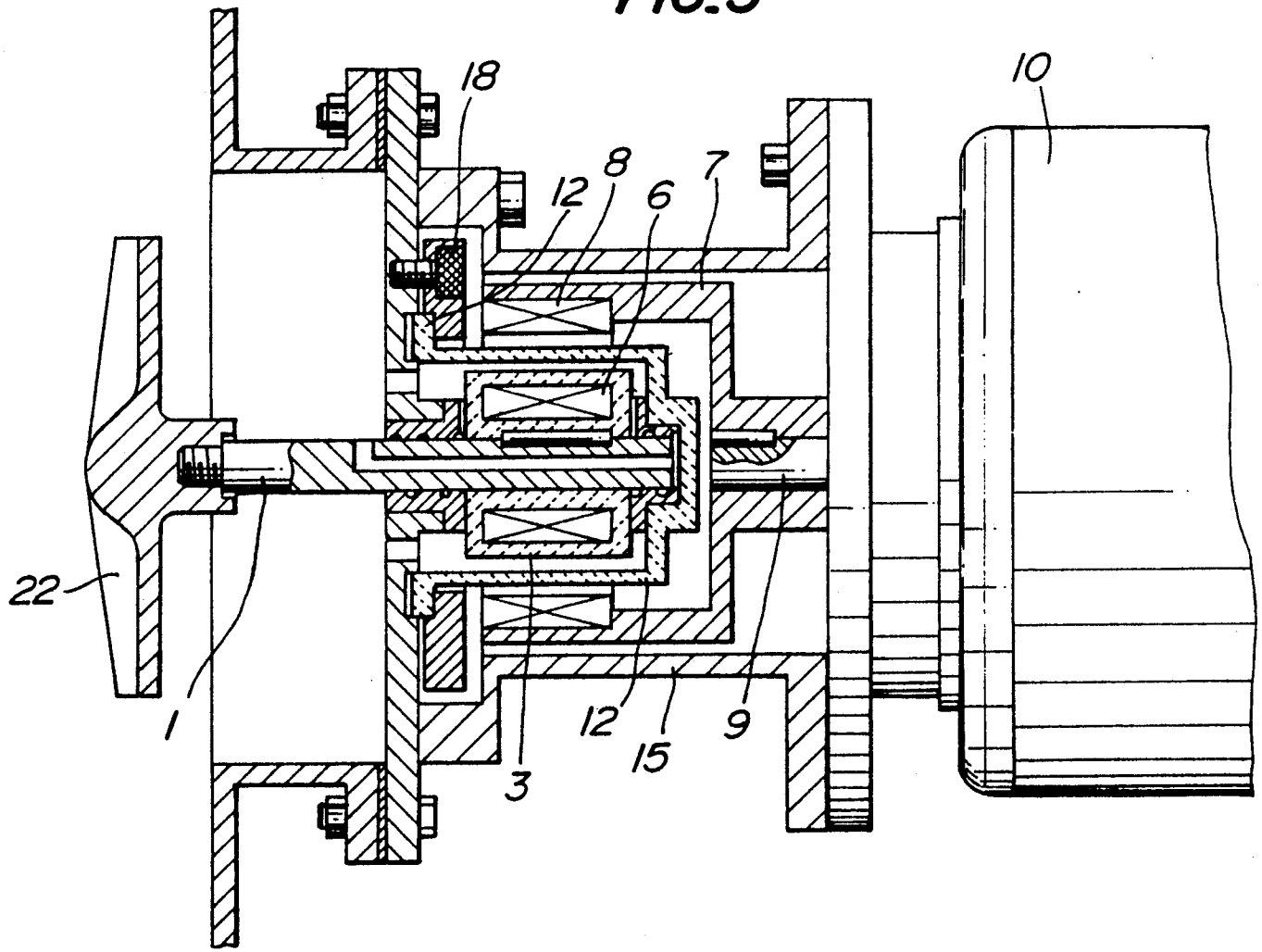
FIG. 3 is a sectional view of a principal part of a magnetic-drive agitator which is another embodiment of the present invention

For example, as is shown in FIG. 3, in an agitator comprising main shaft 1 provided with rotor 3 and vane 22 fixed on one end of the main shaft for agitating fluids, the driving force of the motor is transmitted to vane 22 by means of magnetic coupling to effect agitating or mixing of gas or liquid fluids with a high efficiency.

As is clear from the above description, the structure of the device according to the present invention comprises a magnetic coupling means comprising a specifically thin partition consisting of a ceramic material having a properly defined specific electric resistance, so that the magnetic coupling means has little head generation caused by eddy current wherefore a torque transmitting efficiency of magnets is raised and thus no special measures for diminishing influence of the heat generation are required. Further, the thinner partition can attain an improvement of the torque transmitting efficiency of the magnets and also compaction of the device.

EXAMPLE 1

A magnetic-drive centrifugal pump as shown in FIG. 1 was manufactured.

An impeller having a diameter of 150 mm provided with 5 blades and a rotor 130 mm long having an outside diameter of 102 mm were composed into an integral whole body of alumina. A driven impeller magnet consisting of a permanent magnet 22 mm side was embedded in the rotor on a virtual circumference having a diameter of 81 mm equidistant from a main shaft. A driving magnet consisting of a permanent magnet 25 mm wide was fixed to a magnet holder on a virtual circumference having a diameter of 132 mm equidistant from the main shaft. Both the driven impeller magnet and the driving magnet were 55–160 mm long as shown in Table 1.

For those permanet magnets, a magnet made of rare earth elements having a coercive force of 6500 Oe and a residual flux density of 9.5 KG was employed.

A rear casing constituting a pump casing is provided with, as shown in FIG. 2, a flange portion 12 mm thick having an outside diameter of 140 mm and an inside diameter of 108 mm, and a sidewall 110 mm deep having an inside diameter of 108 mm and a thickness as shown in Table 1, made of such a material as to exhibit a predetermined specific resistance as shown in Table 2.

As driving motor 10, a three phase motor having a revolution of 3,500 RPM and an output of 5.5 KW was prepared.

Of those pumps, shaft driving force of the pump, internal pressure strength and thermal shock breaking temperature of the rear casing and temperature elevation of the treated fluid were respectively measured.

The shaft driving force of the pump was determined by the product of input current, voltage and output efficiency of the motor when the total head of the pump was 30 m and the fluid delivery rate 0.2 $m^3$/min.

The internal pressure strength of the rear casing was determined by calculating its breaking strength when an oil pressure is loaded on the inside of the rear casing.

The thermal shock breaking temperature was represented by the difference between 20° C. and the temperature at which a rear casing had been heated in a furnace when the heated rear casing, immediately after being taken out from the furnace, happened to be broken by water having a temperature of 20° C. poured therein at a flow rate of 10 l/min.

The temperature elevation of treated fluids was determined by the difference in temperature between liquid near the inside periphery of the flange portion of the rear casing and liquid near the inside periphery of the bottom portion of the rear casing.

Results of the measurement are given in Table 1. It can be clearly understood from Table 1 that centrifugal pumps provided with the magnetic-drive device according to the present invention are superior in torque transmitting, cause little temperature elevation of treated fluids and have improved strength and thermal shock resistance as compared with those having a conventional structure.

TABLE 1

| No. | Thickness of partition (mm) | Specific resistance (Ω cm) | Material No.* | Length of driving magnet (mm) | Shaft driving force of pump (KW) | Internal pressure strength of rear casing (kg/cm²) | Thermal shock breaking temperature (°C.) | Temperature elevation of treated fluid (°C.) |
|---|---|---|---|---|---|---|---|---|
| Present Invention | | | | | | | | |
| 1 | 1.5 | $5 \times 10^8$ | 5 | 50 | 3.70 | 50 | 290 | 0.3 |
| 2 | 2.0 | $5 \times 10^8$ | 5 | 55 | 3.70 | 85 | 280 | 0.3 |
| 3 | 3.0 | $5 \times 10^8$ | 5 | 65 | 3.75 | 110 | 270 | 0.3 |
| 4 | 3.0 | $3.6 \times 10^9$ | 9 | 65 | 3.75 | 70 | 200 | 0.3 |
| 5 | 5.0 | $5 \times 10^8$ | 5 | 93 | 3.85 | 165 | 230 | 0.5 |
| 6 | 8.0 | $5 \times 10^8$ | 5 | 140 | 4.05 | 240 | 180 | 0.7 |
| 7 | 8.0 | $3.6 \times 10^9$ | 9 | 140 | 4.04 | 160 | 120 | 0.6 |
| Comparative example | | | | | | | | |
| 8 | 1.3 | $5 \times 10^8$ | 5 | 45 | 3.70 | 32 | 290 | 0.3 |
| 9 | 2.0 | $2 \times 10^{-5}$ | 22 | 55 | 4.42 | 90 | >200 | 7.7 |
| 10 | 2.0 | $2 \times 10^2$ | 20 | 55 | 3:73 | 16 | 170 | 1.4 |
| 11 | 2.0 | $>10^{14}$ | 19 | 55 | 3.70 | 16 | 140 | 0.3 |
| 12 | 8.0 | $2 \times 10^2$ | 20 | 140 | 4.20 | 50 | 90 | 3.1 |
| 13 | 8.0 | $4 \times 10^3$ | 21 | 140 | 4.07 | 43 | 100 | 0.9 |
| 14 | 8.0 | $>10^{14}$ | 19 | 140 | 4.04 | 55 | 60 | 0.6 |
| 15 | 9.0 | $5 \times 10^8$ | 5 | 160 | 4.15 | 260 | 140 | 0.8 |

*Material No. is referred to Table 2

EXAMPLE 2

Zirconia cermaics were prepared having compositions comprising, as main ingredients, zirconia and yttrium oxide as shown in Table 2 in combination with additives having compositions shown in Table 3. As comparative examples, alumina, silicon carbide ceramics and polytetrafluoroethylene-lined steel were prepared.

Respective test-pieces for measurement were produced from the abovementioned materials, which were measured with respect to fluxural strength, specific resistance, fracture toughness, thermal shock resistance temperature and aged flexural stength. The results are given in Table 2. Table 3 shows the compositions.

TABLE 2

| | | Composition # | | | | Characteristics | | | | |
|---|---|---|---|---|---|---|---|---|---|---|
| | | Main ingredient | | Additive | | | | | | |
| No. | Material | $ZrO_2$ (mol. %) | $Y_2O_3$ (mol. %) | Composition No.* | wt %** | Specific resistance (Ω-cm) | Flexural strength (kg/cm²) | Flexural strength (Aging) (%) | Fracture toughness (MN/m$^{3/2}$) | Thermal shock resistance temperature (°C.) |
| 1 | Zirconia | 93.7 | 2.3 | 2 | 2.5 | $3.9 \times 10^8$ | 104 | 8.1 | 10.5 | 390 |
| 2 | Zirconia | 93.5 | 2.5 | 2 | 2.5 | $4.2 \times 10^8$ | 97 | 5.9 | 8.8 | 360 |
| 3 | Zirconia | 93.5 | 2.5 | 1 | 2.5 | $4.9 \times 10^8$ | 91 | 28.5 | 7.1 | 390 |
| 4 | Zirconia | 93.5 | 2.5 | 3 | 2.5 | $4.4 \times 10^8$ | 94 | 8.1 | 8.8 | 360 |
| 5 | Zirconia | 93.0 | 3.0 | 2 | 2.5 | $5.0 \times 10^8$ | 89 | 3.2 | 7.9 | 320 |
| 6 | Zirconia | 94.8 | 3.0 | 2 | 0.7 | $2.5 \times 10^7$ | 66 | 6.8 | 6.2 | 220 |
| 7 | Zirconia | 94.5 | 3.0 | 2 | 1.0 | $6.9 \times 10^7$ | 84 | 5.9 | 6.9 | 250 |
| 8 | Zirconia | 91.0 | 3.0 | 2 | 4.5 | $1.2 \times 10^9$ | 84 | 8.9 | 6.6 | 290 |
| 9 | Zirconia | 90.5 | 3.0 | 2 | 5.0 | $3.6 \times 10^9$ | 74 | 11.3 | 6.0 | 280 |
| 10 | Zirconia | 92.5 | 3.5 | 2 | 2.5 | $6.0 \times 10^8$ | 81 | 3.0 | 7.1 | 270 |
| 11 | Zirconia | 92.5 | 3.5 | 1 | 2.5 | $7.1 \times 10^8$ | 73 | 22.0 | 7.4 | 300 |
| 12 | Zirconia | 92.5 | 3.5 | 3 | 2.5 | $6.2 \times 10^8$ | 77 | 7.3 | 7.1 | 280 |
| 13 | Zirconia | 92.4 | 3.6 | 2 | 2.5 | $5.2 \times 10^8$ | 76 | 3.1 | 6.6 | 250 |
| 14 | Zirconia | 92.0 | 4.0 | 2 | 2.5 | $4.1 \times 10^8$ | 68 | 3.4 | 4.9 | 210 |
| 15 | Zirconia | 94.5 | 1.5 | 2 | 2.5 | $1.1 \times 10^8$ | 15 | — | 3.1 | — |
| 16 | Zirconia | 94.0 | 2.0 | 2 | 2.5 | $3.0 \times 10^8$ | 98 | 15.4 | 9.0 | 370 |
| 17 | Zirconia | 93.8 | 2.2 | 2 | 2.5 | $3.4 \times 10^8$ | 102 | 12.9 | 9.9 | 400 |
| 18 | Zirconia | 90.0 | 3.0 | 2 | 5.5 | $6.2 \times 10^9$ | 64 | 13.4 | 4.7 | 250 |
| 19 | Alumina | — | — | — | 4.0 | $>10^{14}$ | 28 | — | 3.6 | 200 |
| 20 | SSC*** | — | — | — | 0.5 | $2 \times 10^2$ | 39 | — | 2.4 | 370 |
| 21 | SSC*** | — | — | — | 1.0 | $4 \times 10^3$ | 33 | — | 3.0 | 390 |
| 22 | PTFE-lined steel | — | — | — | — | $2 \times 10^{-5}$ | 57 | — | ≈100 | — |

*Composition: No. in Table 3 is referred to.
**wt %: percentage based on the weight of main ingredients.
***SSC: Sintered Silicon Carbide
Composition: Hydrogen and oxygen are summed up to composition to reach 100%

TABLE 3

| Clay No. | Ingredient (wt %) $Al_2O_3$ | $SiO_2$ | RO* | Others |
|---|---|---|---|---|
| 1 | 28 | 45 | 17 | 10 |
| 2 | 8 | 36 | 43 | 13 |
| 3 | 15 | 13 | 27 | 45 |

*RO: Alkaline metal oxide

As a result, it is understandable that zirconia ceramics partially stabilized with 2.3–3.5 mole % $Y_2O_3$ have an improved mechanical strength and a satisfactory specific resistance daptable for the partition of the magnetic coupling means.

Further, it has been ascertained that zirconia ceramics containing 1–5% based on the weight of the main ingredient of alumina ($Al_2O_3$), silica ($SiO_2$) and an alkaline metal oxide have a high specific resistance and a satisfactory mechanical strength.

It is further understood by those skilled in the art that the foregoing description has been made with respect to preferred embodiments of the present invention and that various changes, modifications, alterations and improvements may be made in the invention without departing from the spirit and scope thereof.

What is claimed is:

1. A magnetic-drive device for rotary machinery comprising:

a driving motor and a rotatable motor driven by a magnetic coupling means including a driving magnet fixed on a magnetic holder connected with said driving motor and a driven impeller magnet fixed on a rotor of said rotatable motor, said driving magnet and the driven impeller magnet being combined with each other; and a chamber accomodating said rotatable motor and having a cylindrical partition defining the periphery of the chamber, said partition having a thickness of 1.5–8 mm and comprising a ceramic material having zirconia as a main ingredient, containing 1–5%, based on the weight of the main ingredient, of alumina ($Al_2O_3$), silica ($SiO_2$) and an alkaline metal oxide, and having a specific resistance of at least $10^{7}\Omega$-cm, through which partition the driving magnet and the driven impeller magnet are magnetically coupled.

2. A device as claimed in claim 1 wherein the main ingredient is a zirconia partially stabilized with 2.0–4.0 mole % of $Y_2O_3$.

3. A device as claimed in claim 2 wherein the main ingredient is a zirconia partially stabilized with 2.3–3.5 mole % of $Y_2O_3$.

* * * * *

UNITED STATES PATENT AND TRADEMARK OFFICE

CERTIFICATE OF CORRECTION

PATENT NO. : 5,090,944

DATED : February 25, 1992

INVENTOR(S) : Osamu KYO and Yasuo AKITSU

It is certified that error appears in the above-identified patent and that said Letters Patent is hereby corrected as shown below: ON THE TITLE PAGE In section [73] Assignee, change "NKG Insulators, Ltd" to --NGK Insulators, Ltd.--.

Signed and Sealed this

Twenty-first Day of September, 1993

Bruce Lehman

*Attest:*

BRUCE LEHMAN

*Attesting Officer*

*Commissioner of Patents and Trademarks*